US008939412B2

(12) United States Patent
Tokumaru

(10) Patent No.: US 8,939,412 B2
(45) Date of Patent: Jan. 27, 2015

(54) TRAIN-POSITION LOCATING DEVICE AND TRAIN-POSITION LOCATING METHOD

(75) Inventor: Makoto Tokumaru, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 120 days.

(21) Appl. No.: 13/610,999

(22) Filed: Sep. 12, 2012

(65) Prior Publication Data

US 2013/0112815 A1 May 9, 2013

(30) Foreign Application Priority Data

Nov. 7, 2011 (JP) ..... 2011-243505

(51) Int. Cl.
*B61L 25/02* (2006.01)
*B61L 3/00* (2006.01)
*B61L 27/00* (2006.01)

(52) U.S. Cl.
CPC ..... *B61L 27/0077* (2013.01); *B61L 25/025* (2013.01); *B61L 2205/04* (2013.01)
USPC ..... 246/124; 246/122 R

(58) Field of Classification Search
CPC .... B61L 2205/04; B61L 25/025; B61L 3/006
USPC ..... 246/122 R, 124; 701/19, 20, 470, 412, 701/469, 32.3; 104/26.1
See application file for complete search history.

(56) References Cited

U.S. PATENT DOCUMENTS 5,890,682 A * 4/1999 Welk ..... 246/125
8,239,078 B2 * 8/2012 Siddappa et al. ..... 701/19
2009/0043435 A1 * 2/2009 Kane et al. ..... 701/19

FOREIGN PATENT DOCUMENTS

JP 2004-168216 A 6/2004

* cited by examiner

*Primary Examiner* — Mark Le
(74) *Attorney, Agent, or Firm* — Buchanan Ingersoll & Rooney PC

(57) ABSTRACT

A train-position locating device includes an onboard control device incorporated in a train and a ground control device installed on a ground. The onboard control device decides a track on which a train is present based on position information and a result of a nearest track search, transmits identification information for identifying the own train and track information to the ground control device, and shifts to an onboard-oriented train control mode when receiving a response indicating "position is located" from the ground control device. The ground control device transmits a response indicating "tentative position is normal" to the onboard control device when another train located to be present on a track is not present on the tentative position, and transmits the response indicating "position is located" to the onboard control device when a change from a previous track to the changed track is correct.

12 Claims, 4 Drawing Sheets

TRAIN-POSITION LOCATING DEVICE AND TRAIN-POSITION LOCATING METHOD

BACKGROUND OF THE INVENTION

1. Field of the Invention

The present invention relates to a train-position locating device and a train-position locating method for locating a train position.

2. Description of the Related Art

There is conventionally known an onboard-oriented train control device that actively manages the track position of a train and that controls a train speed. The onboard-oriented train control device has GPS antennas and GPS receivers that are arranged in a distributed manner in a train constituted by a plurality of railway vehicles so as to improve the reliability of detection of the train position, and includes a storage device that stores therein route maps and GPS-antenna installation position information. The onboard-oriented train control device performs a positioning calculation by causing each GPS receiver to receive GPS signals from at least four satellites, and recognizes the track position and direction of the entire train by using the route maps. Japanese Patent Application Laid-open No. 2004-168216 discloses such a technique.

However, according to the above conventional technique, GPS-based detected positions have errors although the onboard-oriented train control device corrects the train position to correspond to the route maps using the GPS signals as needed. Therefore, the conventional technique has a problem that it is unable to locate the train position even in a combination of the route maps at locations, such as rail yards and railway stations, where a plurality of tracks are arranged to be adjacent to one another in parallel to such a degree that it is impossible to detect the train position with position detection accuracy of a GPS.

The present invention has been achieved in view of the above problems, and an object of the present invention is to provide a train-position locating device that can locate a train position at places such as rail yards and railway stations, where a plurality of tracks are adjacent to one another.

SUMMARY OF THE INVENTION

It is an object of the present invention to at least partially solve the problems in the conventional technology.

A train-position locating device according to an aspect of the present invention includes: an onboard control device incorporated in a train; a ground control device installed on a ground; and a train detection device that is installed on a ground and that detects tracks on each of which a train is present. The onboard control device is connected to the ground control device by wireless communication. The onboard control device decides a track on which a train is present based on position information detected by a GPS receiver incorporated in the own train and a result of a nearest track search, transmits identification information for identifying the own train and track information to the ground control device whenever the track changes, and shifts to an onboard-oriented train control mode when receiving a response indicating "position is located" from the ground control device. The ground control device transmits a response indicating "tentative position is normal" to the onboard control device when another train located to be present on a track is not present on the track decided as a tentative position received from the onboard control device, and transmits the response indicating "position is located" to the onboard control device when a change from a previous track to the changed track received from the onboard control device is correct.

A train-position locating method according to an aspect of the present invention for a train-position locating device including an onboard control device incorporated in a train, a ground control device installed on a ground, and a train detection device that is installed on a ground and that detects tracks on each of which a train is present, the on-board control device being connected to the ground control device by wireless communication, includes: a tentative position deciding step of causing the onboard control device to decide a track defined as a tentative position based on position information detected by a GPS receiver incorporated in the own train and a result of a nearest track search, and to transmit identification information for identifying the own train and track information on the track defined as the tentative position to the ground control device; a tentative position determining step of causing the ground control device to acquire information on the tracks on each of which a train is present from the train detection device, to transmit a response indicating "tentative position is not normal" to the onboard control device when another train located to be present is present on the track decided as the tentative position received from the onboard control device, to transmit a response indicating "tentative position is normal" to the onboard control device when another train located to be present is not present on the track decided as the tentative position; a track changing step of causing the onboard control device to transmit the identification information and track information on a changed track to the ground control device when the onboard control device receives the response indicating "tentative position is normal" from the ground control device and the track on which the train is present changes as a result of running of the own train; a position locating determining step of causing the ground control device to transmit a response indicating "position is located" to the onboard control device when a change from a previous track to the changed track in the onboard control device matches a content of track link information that is included in the ground control device and that indicates a correction relation of the tracks, and to transmit the response indicating "tentative position is not normal" to the onboard control device when the change from the previous track to the changed track in the onboard control device does not match the content of the track link information; a control mode shifting step of causing the onboard control device to shift to an onboard-oriented train control mode when the onboard control device receives the response indicating "position is located"; and a tentative position re-deciding step of causing the onboard device to decide the track as the tentative position again and to transmit the identification information and the track information to the ground control device when the onboard device receives a response indicating "tentative position is not normal".

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a train-position locating device according to the present invention will be explained below in detail with reference to the accompanying drawings. The present invention is not limited to the embodiments.

First Embodiment

Figure 1:
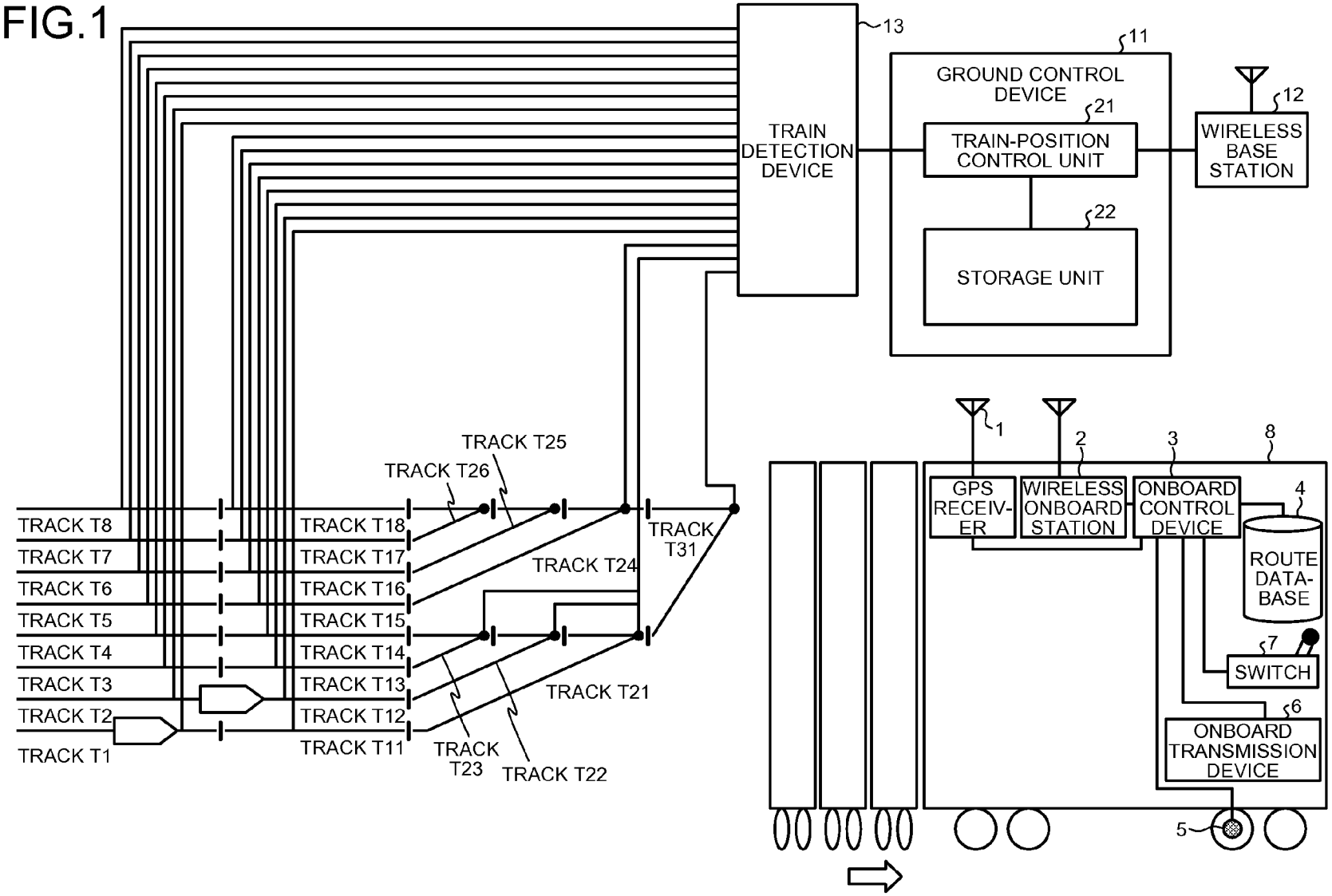
FIG. 1 is an example of a configuration of a train-position locating device.

FIG. 1 is an example of a configuration of a train-position locating device according to the present embodiment. The train-position locating device is configured to include an onboard device constituted by devices or the like incorporated in a train and a ground device constituted by devices and the like installed on a ground.

A configuration of the onboard device is explained. The onboard device includes a GPS receiver 1 that has identification information of an ID: 1*a*, a wireless onboard station 2 that holds wireless communication with the ground device, a route database 4 that stores therein kilometer-mileages on tracks on which a train runs to correspond to latitude and longitude information received from the GPS receiver 1, an onboard control device 3 that manages positions of the train and that executes a speed control while referring to information from the route database 4 and the wireless onboard station 2, a speed generator 5 that generates pulses in proportion to rotation of a wheel, an onboard transmission device 6 that allows the onboard control device 3 of a lead vehicle 8 and that of a rearmost vehicle (not shown) to transmit and receive information to and from each other as needed, a switch 7 that includes a running-direction changeover switch, a driver's cab decision switch, and the like, and the vehicle (the lead vehicle) 8 a moving direction of which is decided according to a state of the switch 7. While the ID of the GPS receiver 1 is used herein as the identification information for identifying the train, the identification information is not limited to the ID but identification information other than the ID can be used. Furthermore, in FIG. 1, an arrow shown under the train denotes the moving direction of the train.

A configuration of the ground device is explained next. The ground device includes a ground control device 11 that manages track positions of a plurality of trains on which the trains are present, and that transmits train-interval control information and unscheduled speed-control information generated based on the track information to the onboard control devices 3 via a wireless base station 12, the wireless base station 12 that holds the wireless communication with the onboard device, and a train detection device 13 that determines the position of the train (the vehicle) according to a state of a track circuit (a track). Furthermore, the ground control device 11 includes a train-position control unit 21 that performs a process for locating the train position, and a storage unit 22 that holds therein a track position of each vehicle received via the train detection device 13 and the wireless base station 12 and track link information that indicates a connection relation among tracks. In the following descriptions, the train-position control unit 21 mainly performs all processes that are performed by the ground control device 11.

In the onboard device, the onboard control device 3 performs a computation process by combining the information from the GPS receiver 1 and a result of sequentially computing moving distances of the train including the lead vehicle 8 based on a pulse count obtained from the speed generator 5, and updates position information. The onboard control device 3 transmits the position information to the ground control device 11 via the wireless onboard station 2 and the wireless base station 12.

The ground control device 11 receives information from the train detection device 13, and monitors states of the tracks at rail yards or railway stations. The train detection device 13 can detect which of the tracks (tracks T1 to T8, T11 to T18, T21 to T26, and T31) a train is present on; however, the train detection device 13 is unable to detect the identification information on the train.

When the onboard control device 3 is powered on, the onboard control device 3 refers to the route database 4 based on the latitude and longitude information (as well as altitude information depending on the state) obtained from the GPS receiver 1, and locates a position of the train (the lead vehicle 8) on a track section using a nearest point search that is one of solutions to an optimization problem for searching a near point in a distance space. At this time, there is a probability that it is impossible to accurately locate the position with ordinary accuracy (about 5 meters) of a GPS at places such as railway stations and rail yards where a plurality of tracks are adjacent to one another although it is possible to locate the position in a case where only one track is present within position detection accuracy of the GPS. On the other hand, at each of the railway stations or the rail yards, the train detection device 13 is normally provided for detecting the position of each train, and the train detection device 13 can identify on which track the vehicle is present according to the state of the track circuit (the track). Therefore, in the present embodiment, information on the state of the track circuit (the track) from the train detection device 13 is used at a time of locating a track position of the lead vehicle 8.

Figure 2:
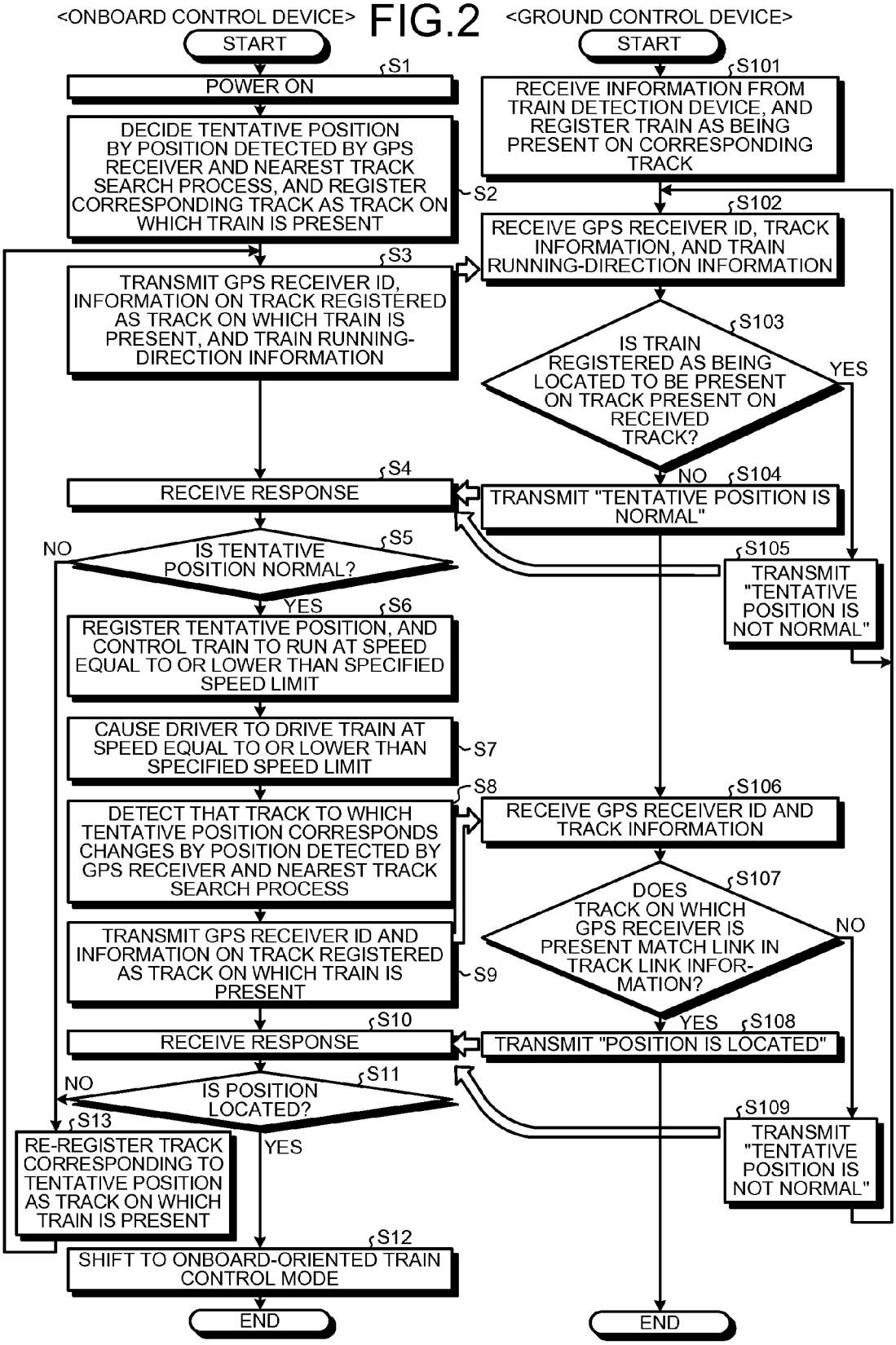
FIG. 2 is a flowchart of a train-position locating process.

A train-position locating method for the train-position locating device is explained next. FIG. 2 is a flowchart of a train-position locating process.

First, when being powered on (Step S1), the onboard control device 3 refers to the route database 4 based on the latitude and longitude information obtained from the GPS receiver 1, tentatively decides that a lead (a position of a GPS antenna, to be exact) of the train is present at a ○○ kilometer-mileage on the track T1 by a nearest track search process (the nearest point search), and registers the track T1 corresponding to a tentative position that is a tentatively decided position as a tack on which the train is present (Step S2). The onboard control device 3 transmits information on the track (the track T1) on the tentative position and the ID (1*a*) of the GPS receiver 1 as well as train running-direction information acquired from the switch 7 to the ground control device 11 via the wireless onboard station 2 and the wireless base station 12 (Step S3).

Meanwhile, the ground control device 11 receives information indicating that the train detection device 13 detects that the train is present on the track T1 from the train detection device 13, and registers the train as being present on the corresponding track (Step S101). Thereafter, the ground control device 11 receives the GPS receiver ID, the track information, and the train running-direction information from the onboard control device 3 (Step S102).

Figure 3:
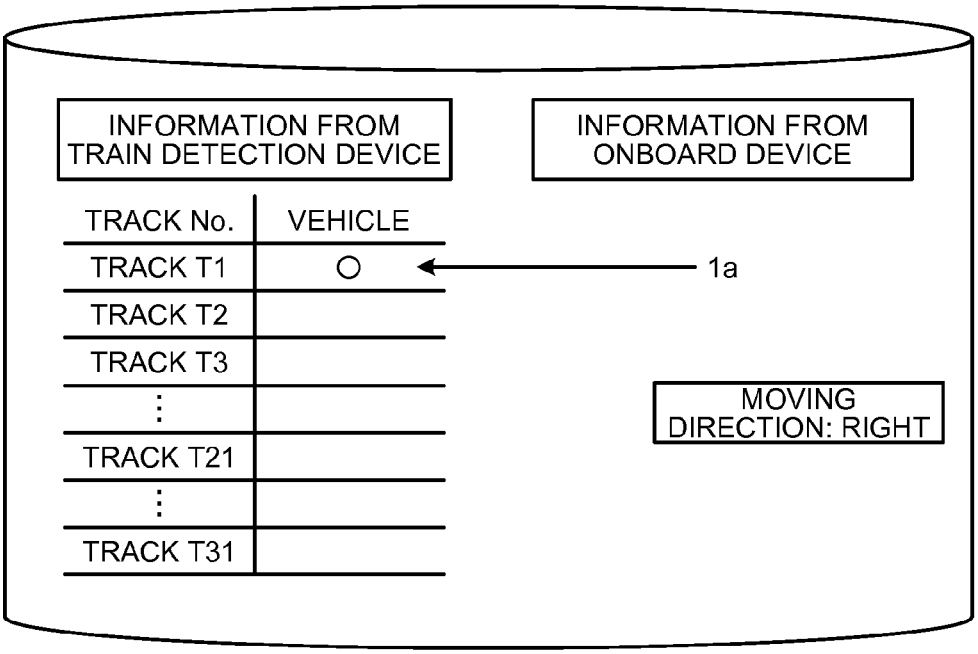
FIG. 3 is an example of a configuration of a train-position management table.

The ground control device 11 includes a train-position management table that is provided in the storage unit 22 and that stores therein the information from the train detection device 13 and the information from the onboard control device 3 while the information from the train detection device 13 and the information from the onboard control device 3 are made to correspond to each other. The ground control device 11 manages the information indicating that the train position is detected, the ID of the GPS receiver 1, and the train running direction in an area of the train-position management table that corresponds to the track T1 based on the information from the train detection device 13 while making the information indicating that the train position is detected, the ID of the GPS receiver 1, and the train running direction correspond to one another. FIG. 3 is an example of a configuration of the train-position management table held in the storage unit 22. In the train-position management table, a "○ (circle)" mark is put on the track on which the train is present based on the information from the train detection device 13, and it is shown that the track information that is the information from the onboard control device 3 and the ID: 1*a* of the GPS receiver 1 are made to correspond to the tack with the circle mark.

The ground control device 11 confirms whether a train registered as being located to be present on the track is present on the track received from the onboard control device 3 in relation to the GPS receiver ID (Step S103). Specifically, when acquiring the information indicating that the train having the GPS receiver 1 (ID: 1*a*) is present on the track T1 from the onboard control device 3, the ground control device 11 confirms whether the train that is located to be present on the track T1 is already present. "Being located to be present on the track" means that a position of the track on which a train having a specific GPS receiver ID is present is located. When the train is not present on the track T1 (NO at Step S103), the ground control device 11 transmits a response indicating "tentative position is normal" to the onboard control device 3 via the wireless base station 12 and the wireless onboard station 2 (Step S104). On the other hand, when the train is present on the track T1 (YES at Step S103), the ground control device 11 transmits a response indicating "tentative position is not normal" to the onboard control device 3 via the wireless base station 12 and the wireless onboard station 2 (Step S105).

The onboard control device 3 receives the response from the ground control device 11 (Step S4). When the received response indicates that "tentative position is normal" (YES at Step S5), the onboard control device 3 sets a state of the onboard control device 3 itself as a state of registering the tentative position, and controls the train to run at a speed equal to or lower than a specified speed limit (20 km/h, for example) because there is a probability of erroneous entry until the track position is located (Step S6). A driver drives the train at a speed equal to or lower than the speed limit (Step S7). When it is detected from the position detected by the GPS receiver 1 and the nearest track search process (the nearest point search) that the track to which the tentative position corresponds changes as a result of running of the lead vehicle 8 (Step S8), the onboard control device 3 transmits track information on the tentative position and the ID: 1*a* of the GPS receiver 1 to the ground control device 11 via the wireless onboard station 2 and the wireless base station 12 (Step S9). Specifically, this corresponds to a case where the lead vehicle 8 moves from the track T1 to the track T11.

Figure 4:
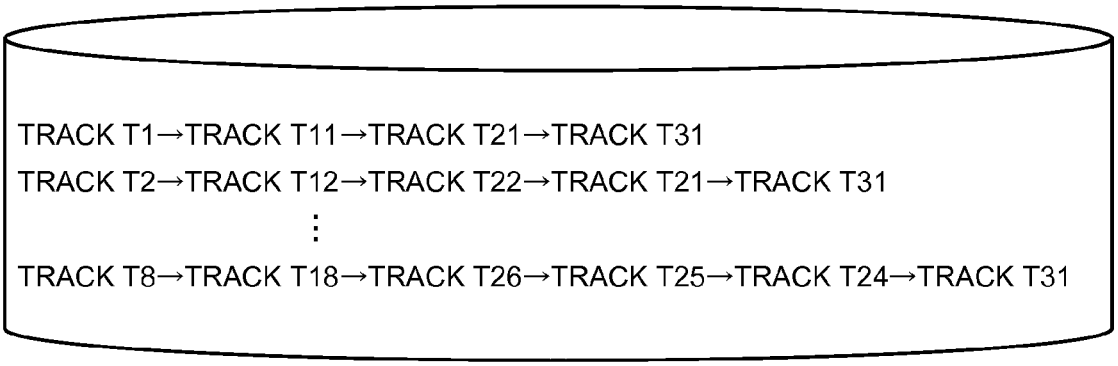
FIG. 4 is an example of a configuration of track link information.

The ground control device 11 receives the GP receiver ID and the track information from the onboard control device 3 (Step S106). The ground control device 11 confirms whether the received track information matches a link in the track link information held in the storage unit 22 (Step S107). Specifically, the ground control device 11 confirms a change from the previous track to the changed track matches a content of the track link information. "Matches the track link information" means the change from the previous track to the changed track is correct. FIG. 4 is an example of a configuration of the track link information held in the storage unit 22. The track link information indicates the connection relation (links) among the tracks as to, when a train present on a certain track runs, on which track the train runs next. For example, the track link information indicates that the train present on the track T1 moves on the tracks from the track T1 in an order of the track T11→the track T21→the track T31.

When the track on which the GPS receiver 1 is present matches the link in the track link information (YES at Step S107), the ground control device 11 transmits a response indicating "position is located" to the onboard control device 3 via the wireless base station 12 and the wireless onboard station 2 (Step S108), and the process performed by the ground control device 11 ends. On the other hand, the track on which the GPS receiver 1 is present does not match the link in the track link information (NO at Step S107), the ground control device 11 transmits a response indicating "tentative position is not normal" to the onboard control device 3 via the wireless base station 12 and the wireless onboard station 2 (Step S109).

The onboard control device 3 receives the response from the ground control device 11 (Step S10). When the received response indicates that position is located (YES at Step S11), the onboard control device 3 shifts a control mode to an onboard-oriented train control mode (Step S12), and the process performed by the onboard control device 3 ends.

Meanwhile, when the received response indicates that tentative position is not normal (NO at Step S11), the onboard control device 3 re-registers the track corresponding to the tentative position as the track on which the train is present (Step S13). Thereafter, the process returns to Step S3, and the onboard control device 3 transmits the track information on the tentative position and the ID of the GPS receiver 1 as well as the train running-direction information acquired from the switch 7 to the ground control device 11 via the wireless onboard station 2 and the wireless base station 12 (Step S3).

The onboard control device 3 receives the response from the ground control device 11 at Step S4. When the received response indicates that tentative position is not normal (NO at Step S5), the onboard control device 3 re-registers the track corresponding to the tentative position as the track on which the train is present (Step S13). Thereafter, the process returns to Step S3, and the onboard control device 3 transmits the track information on the tentative position and the ID of the GPS receiver 1 as well as the train running-direction information acquired from the switch 7 to the ground control device 11 via the wireless onboard station 2 and the wireless base station 12 (Step S3).

Furthermore, when the ground control device 11 transmits a response indicating "tentative position is not normal" (Steps S105 and S109), the onboard control device 3 transmits again the track information, the ID of the GPS receiver 1, and the train running-direction information to the ground control device 11. Therefore, the process returns to Step S102, and the ground control device 11 receives again these pieces of information (Step S102). Subsequent operations are the same as those described above.

The onboard control device 3 decides the track on which the train is present based on the position information detected by the GPS receiver 1 incorporated in the own train and the result of the nearest track search. The onboard control device 3 transmits the identification information for identifying the own train and the track information to the ground control device 11 whenever the track changes, and shifts the control mode to the onboard-oriented train control mode when receiving a response indicating "position is located" from the ground control device 11. Furthermore, the ground control device 11 transmits a response indicating "tentative position is normal" to the onboard control device 3 when another train located to be present on the track corresponding to the tentative position received from the onboard control device 3 is not present. Furthermore, the ground control device 11 transmits the response indicating "position is located" to the onboard control device 3 when the change from the previous track to the changed track received from the onboard control device 3 is correct.

This process is explained below with a specific example. For example, when the onboard control device 3 sets the track T1 as the tentative position, the onboard control device 3 transmits the information to the effect to the ground control device 11.

The ground control device 11 transmits a response indicating "tentative position is not normal" to the onboard control device 3 when another train is already present on the track T1, and transmits the response indicating "tentative position is normal" to the onboard control device 3 when another train is not present on the track T1.

When receiving the response indicating "tentative position is not normal", the onboard control device 3 repeatedly transmits the track information to the ground control device 11—for example, changes the track T1 to the track T2 until receiving the response indicating "tentative position is normal".

When the onboard control device 3 receives the response indicating "tentative position is normal" and the track on which the train is present changes (the track T1→the track T11, for example) as a result of the running of the train, the onboard control device 3 transmits changed track information to the ground control device 11.

When the train in which the onboard control device 3 is incorporated is changing tracks like the track link information, the ground control device 11 locates the position. On the other hand, the change does not match the track link information such as a case where the track on which the train in which the onboard control device 3 is incorporated runs changes like the track T1→the track T12, the ground control device 11 transmits the response indicating "tentative position is not normal" to the onboard control device 3. Specifically, this is a case where the track T1 that should be the track T2 is initially registered as the tentative position if the changed track is the track T12.

The onboard control device 3 repeatedly transmits the track information, for example, changes the track T1 to the track T2 as described above until receiving the response indicating "tentative position is normal" even if the onboard control device 3 receives the response indicating "tentative position is not normal" at this stage.

In this way, transmission and reception of the information between the onboard control device 3 and the ground control device 11 makes it possible to locate the position of the track on which the train in which the onboard control device 3 is incorporated is present.

As described above, in the train-position locating device configured to include the ground device and the onboard device, the onboard control device 3 of the onboard device decides the tentative position of the track on which the own train is present based on the GPS information and the information stored in the route database 4, and transmits the tentative position information to the ground control device 11. The ground control device 11 transmits the response indicating "tentative position is normal" to the onboard control device 3 when confirming that the tentative position is correct by using the information from the train detection device 13. The onboard control device 3 transmits the information on the track position to the ground control device 11 when the track position changes as a result of the running of the train. The ground control device 11 locates the position when the track change in the onboard control device 3 is correct. It is thereby possible to locate the position of the track on which the train is present even if a plurality of tracks are adjacent to one another within the position detection accuracy of the GPS signals.

Second Embodiment

In the first embodiment, a case where the onboard device includes one GPS receiver has been explained. In the present embodiment, a case where the onboard device includes a plurality of GPS receives is explained. Elements different from those in the first embodiment are explained below.

Figure 5:
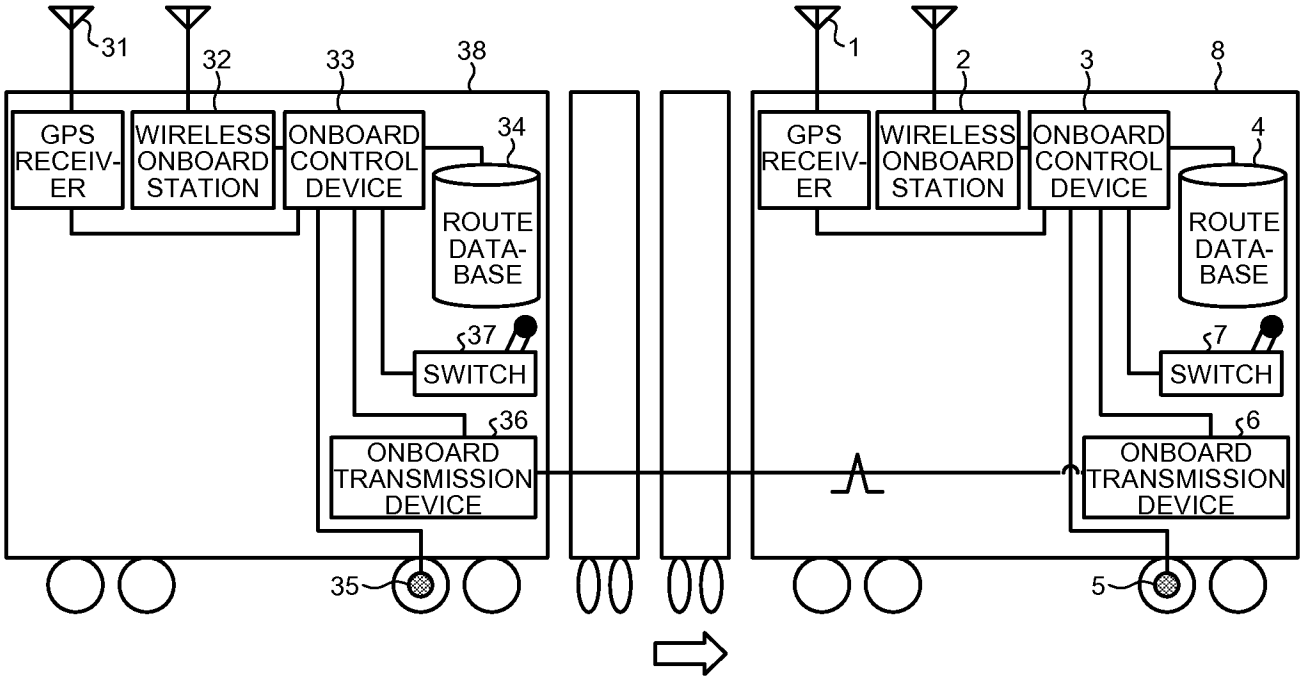
FIG. 5 is an example of a configuration of an onboard device.

FIG. 5 is an example of a configuration of the onboard device according to the present embodiment. While the onboard device according to the present embodiment is identical in the configuration in the lead vehicle 8 of the train to that according to the first embodiment, the onboard device according to the present embodiment in a rearmost vehicle 38 of the train is also identical in the configuration to that in the lead vehicle 8. The onboard device also includes a GPS receiver 31 having identification information of an ID: 1*b*, a wireless onboard station 32, an onboard control device 33, a route database 34, a speed generator 35, an onboard transmission device 36, a switch 37, and the vehicle (the rearmost vehicle) 38. While the lead vehicle 8 is identical in configuration to the rearmost vehicle 38, the lead vehicle 8 collectively holds communication with the ground device by transmitting position information and the like on the rearmost vehicle 38 from the onboard transmission device 36 to the onboard transmission device 6 of the lead vehicle 8. Accordingly, the same processes as those according to the first embodiment are performed between the onboard device and the ground device.

In the first embodiment, the track position is decided by using one GPS receiver 1. In the present embodiment, the two GPS receivers 1 and 31 are used to decide the track position. This enables latitude and longitude information from the two GPS receivers to be used. Therefore, it is possible to improve the position detection accuracy for the own train, and to decrease states of "tentative position is not normal" at a time of deciding the tentative position. While a case where two GPS receivers are used has been explained, the number of GPS receivers is not limited to two and three or more GPS receivers can be also used.

As described above, according to the present embodiment, the onboard device decides the track position by using the information from a plurality of GPS receivers. It is thereby possible to improve the position detection accuracy for the own train, and to decrease the states of "tentative position is not normal".

As described above, the train-position locating device according to the present invention is useful for an automatic train control device that controls a plurality of train speeds and particularly suitable for a case where an onboard device actively manages train positions.

According to the present invention, it is possible to locate a train position at places, such as rail yards and railway stations, where a plurality of tracks are adjacent to one another.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A train-position locating device comprising:

an onboard control device incorporated in a train;

a ground control device installed on a ground; and a train detection device installed on the ground and configured to detect the presence of trains on a plurality of tracks, the onboard control device being connected to the ground control device by wireless communication, the onboard control device being configured to:

determine a track on which the train is present based on position information detected by a GPS receiver incorporated in the train and a result of a nearest track search, transmit identification information for identifying the own train and track information to the ground control device at the time of switching to a different track from among the plurality of tracks, and shift to an onboard-oriented train control mode upon receiving a response indicating "position is located" from the ground control device, and the ground control device being configured to:

transmit a response indicating "tentative position is normal" to the onboard control device when another train is not present on the track decided as a tentative position received from the onboard control device, and transmit the response indicating "position is located" to the onboard control device when a change from the track to the different track from among the plurality of tracks received from the onboard control device is correct.

2. The train-position locating device according to claim 1, wherein the onboard control device:

decides a track as the tentative position based on position information detected by the GPS receiver incorporated in the train and the result of the nearest track search, transmits identification information for identifying the train and track information on the track decided as the tentative position to the ground control device, transmits the identification information and track information on the different track from among the plurality of tracks to the ground control device when the onboard control device receives the response indicating "tentative position is normal" from the ground control device as a response to transmission of the identification information and the track information on the track decided as the tentative position to the ground control device and the track on which the train is present changes, shifts to the onboard-oriented train control mode when receiving the response indicating "position is located" from the ground control device as a response to the transmission of the identification information and the track information on the different track from among the plurality of tracks to the ground control device, and decides the track as the tentative position again and transmits the identification information and the track information to the ground control device when receiving a response indicating "tentative position is not normal" from the ground control device at a time of transmitting the two responses, and the ground control device:

acquires information on the plurality of tracks on each of which a train is present from the train detection device, transmits the response indicating "tentative position is not normal" to the onboard control device when another train is present on the track decided as the tentative position received from the onboard control device, transmits the response indicating "tentative position is normal" to the onboard control device when another train is not present on the track decided as the tentative position, transmits the response indicating "position is located" to the onboard control device when the change from the track to the different track from among the plurality of tracks received from the onboard control device matches a content of track link information that is included in the ground control device and that indicates a connection relation of the tracks, and transmits the response indicating "tentative position is not normal" to the onboard control device when the change from the track to the different track from among the plurality of tracks received from the onboard control device does not match the content of the track link information.

3. The train-position locating device according to claim 1, wherein the onboard control device uses position information detected by a GPS receiver installed in a lead vehicle of the train.

4. The train-position locating device according to claim 2, wherein the onboard control device uses position information detected by a GPS receiver installed in a lead vehicle of the train.

5. The train-position locating device according to claim 1, wherein the onboard control device uses position information detected by a GPS receiver installed in each of a lead vehicle and a rearmost vehicle of the train.

6. The train-position locating device according to claim 2, wherein the onboard control device uses position information detected by a GPS receiver installed in each of a lead vehicle and a rearmost vehicle of the own train.

7. The train-position locating device according to claim 1, wherein the onboard control device controls the own train to run at a speed equal to or lower than a specified speed limit when receiving the response indicating "tentative position is normal" from the ground control device.

8. The train-position locating device according to claim 2, wherein the onboard control device controls the own train to run at a speed equal to or lower than a specified speed limit when receiving the response indicating "tentative position is normal" from the ground control device.

9. The train-position locating device according to claim 3, wherein the onboard control device controls the own train to run at a speed equal to or lower than a specified speed limit when receiving the response indicating "tentative position is normal" from the ground control device.

10. The train-position locating device according to claim 4, wherein the onboard control device controls the own train to run at a speed equal to or lower than a specified speed limit when receiving the response indicating "tentative position is normal" from the ground control device.

11. The train-position locating device according to claim 5, wherein the onboard control device controls the own train to run at a speed equal to or lower than a specified speed limit when receiving the response indicating "tentative position is normal" from the ground control device.

12. The train-position locating device according to claim 6, wherein the onboard control device controls the own train to run at a speed equal to or lower than a specified speed limit when receiving the response indicating "tentative position is normal" from the ground control device.

* * * * *